US008651807B2

(12) United States Patent
Inada et al.

(10) Patent No.: US 8,651,807 B2
(45) Date of Patent: Feb. 18, 2014

(54) FAN WITH REDUCED NOISE

(75) Inventors: Naoya Inada, Nagano (JP); Toshiyuki Nakamura, Nagano (JP); Toshiki Ogawara, Nagano (JP); Yoshinori Miyabara, Nagano (JP)

(73) Assignee: Sanyo Denki Co., Ltd., Tokyo (JP)

( * ) Notice: Subject to any disclaimer, the term of this patent is extended or adjusted under 35 U.S.C. 154(b) by 475 days.

(21) Appl. No.: 13/089,567

(22) Filed: Apr. 19, 2011

(65) Prior Publication Data

US 2011/0255957 A1 Oct. 20, 2011

(30) Foreign Application Priority Data

Apr. 20, 2010 (JP) ..... 2010-097131
Mar. 23, 2011 (JP) ..... 2011-064585

(51) Int. Cl.
*F01D 25/24* (2006.01)

(52) U.S. Cl.
USPC ..... 415/208.2; 415/220; 415/211.2

(58) Field of Classification Search
USPC ..... 415/182.1, 219.1, 222, 208.2, 211.2, 415/220
See application file for complete search history.

(56) References Cited

U.S. PATENT DOCUMENTS

| | | | | |
|---|---|---|---|---|
| 7,234,919 | B2 * | 6/2007 | Lee et al. | 415/208.2 |
| 7,275,911 | B2 * | 10/2007 | Lee et al. | 415/211.2 |
| 7,329,091 | B2 * | 2/2008 | Yan et al. | 415/191 |
| 7,391,611 | B2 * | 6/2008 | Ko et al. | 361/695 |
| 7,824,154 | B2 * | 11/2010 | Yabuuchi | 415/211.2 |
| 2006/0067816 | A1 * | 3/2006 | Chang et al. | 415/191 |
| 2008/0193287 | A1 * | 8/2008 | Kobayashi et al. | 415/208.2 |
| 2009/0081036 | A1 * | 3/2009 | Takeshita et al. | 415/208.2 |
| 2009/0110551 | A1 * | 4/2009 | Yoshida | 415/208.2 |
| 2009/0226312 | A1 * | 9/2009 | Liu et al. | 415/211.2 |

FOREIGN PATENT DOCUMENTS

JP 2010-007545 1/2010

* cited by examiner

*Primary Examiner* — Edward Look
*Assistant Examiner* — William Grigos
(74) *Attorney, Agent, or Firm* — Rankin, Hill & Clark LLP

(57) ABSTRACT

Four tapered portions are formed on an end portion of an inner wall surface of an air channel at four locations corresponding to four corners of the profile of a surface of a housing where a suction port is formed. The four tapered portions are each inclined outwardly in a radial direction of a rotary shaft from a discharge port side toward the suction port side and extending in a rotational direction of an impeller. The tapered portions each include a main portion which is shaped such that an angle formed between the main portion and an axis of the rotary shaft gradually becomes smaller from one end of the main portion located rearward as viewed in the rotational direction of the impeller toward the other end of the main portion located forward as viewed in the rotational direction of the impeller.

15 Claims, 10 Drawing Sheets

FAN WITH REDUCED NOISE

BACKGROUND OF THE INVENTION

1. Field of the Invention

The present invention relates to a fan (air blower fan) including an axial flow fan, a centrifugal fan, and so forth.

2. Description of the Related Art

Japanese Patent Application Publication No. 2010-7545 discloses, as an example of a fan, an axial flow fan including an impeller including a plurality of blades, a motor that rotates the impeller, and a housing having an air channel that allows an air to be sucked from the suction port and discharged from the discharge port when the impeller rotates. In the axial flow fan, a surface of the housing, in which the suction port is formed, is a substantially rectangular in profile. For the purpose of reducing noise produced from around the suction port to reduce noise produced from the entire fan, four tapered portions are formed on an end portion of an inner wall surface of the air channel at four locations corresponding to four corners of the profile of the surface of the housing where the suction port is formed, the four tapered portions being each inclined outwardly in the radial direction of a rotary shaft from the discharge port side toward the suction port side and extending in the rotational direction of the impeller.

SUMMARY OF THE INVENTION

However, the structure according to the related art is limited in noise reduction effect.

An object of the present invention is to provide a fan with a noise reduction effect improved over the related art.

A fan improved by the present invention includes an impeller including a plurality of blades, a motor including a rotary shaft that rotates the impeller, and a housing. The term "fan" as used herein refers to a fan that sucks and discharges an air through rotation of an impeller, including an axial flow fan, a centrifugal fan, a diagonal flow fan, and so forth. The housing has a suction port, a discharge port, and an air channel that houses at least the impeller and allows an air to be sucked from the suction port and discharged from the discharge port when the impeller rotates. A surface of the housing, in which the suction port is formed, is substantially rectangular in profile. The term "substantially rectangular" refers to a perfect rectangular shape with four right-angled corners, a rectangular shape with slightly rounded or tapered corners, a rectangular shape with a groove portion formed at the outer peripheral portion of the rectangular profile to serve as an engagement portion for engagement of a lead wire, and so forth. Four tapered portions are formed on an end portion of an inner wall surface of the air channel at four locations corresponding to four corners of the profile of the surface of the housing where the suction port is formed. The four tapered portions are each inclined outwardly in a radial direction of the rotary shaft from the discharge port side toward the suction port side, and extend in the rotational direction of the impeller. In the present invention, the tapered portions each include a main portion which is shaped such that an angle formed between the main portion and an axis of the rotary shaft becomes gradually smaller from one end of the main portion located rearward as viewed in the rotational direction toward the other end of the main portion located forward as viewed in the rotational direction. The term "angle . . . becomes gradually smaller" refers to a case where the angle becomes smaller stepwise in addition to a case where the angle becomes continuously smaller.

With the main portion of each of the tapered portions at the four corners shaped such that the angle between the main portion and the axis of the rotary shaft becomes gradually smaller from the one end of the main portion located rearward as viewed in the rotational direction toward the other end of the main portion located forward as viewed in the rotational direction as in the present invention, noise produced on the suction port side can be suppressed compared to the related art. This is presumed to be because the shape of each of the tapered portions defined in the present invention reduces the friction resistance between an air flowing into the housing and the edge portion of the suction port to allow the air to be smoothly sucked into the housing. It has been confirmed that the sound pressures for frequency components in a high frequency range, among frequency components in noise produced from the entire fan, according to the configuration of the present invention. It also has been confirmed that a peak of the sound pressure for frequency components in noise produced due to the number of the blades of the impeller, is reduced according to the configuration of the present invention. The inventors consider that this phenomenon contributes to reducing noise from the entire fan.

More specifically, assuming that the air channel is halved by an imaginary plane that is perpendicular to the axis into a first air channel portion located on the suction port side and a second air channel portion located on the discharge port side, the tapered portions at the four corners must be formed on an inner wall surface of the first air channel portion.

Preferably, the main portion of each of the tapered portions has a first side section located on the discharge port side and extending in the rotational direction, a second side section located on the suction port side, and a third side section connecting the first side section and the second side section, and is shaped such that the second side section approaches the first side section in the rotational direction. With this configuration, the air can be more smoothly sucked.

An end portion of the second side section of each of the tapered portions that is on a side of the one end may be continuous with the surface of the housing in which the suction port is formed, and the first side section and the second side section may be converged on an end portion on a side of the other end. With this configuration, the air can be further smoothly sucked.

A parallel surface extending along the second side section and in parallel with the axis may be formed on a portion of the inner wall surface of the first air channel portion other than the tapered portions.

In the case where a surface of the housing, in which the discharge port is formed, is substantially rectangular in profile, another four tapered portions may preferably be formed on an end portion of an inner wall surface of the second air channel portion at four locations corresponding to four corners of the profile of the surface of the housing where the discharge port is formed, and the tapered portions are each inclined outwardly in the radial direction of the rotary shaft from the suction port side toward the discharge port side and extending in the rotational direction of the impeller. With this configuration, noise produced from the discharge port side can be reduced.

Preferably, the four tapered portions provided in the vicinity of the suction port are equal in length in the rotational direction. With this configuration, the air can be sucked into the housing generally uniformly in spite of the presence of the four tapered portions.

In consideration of practical use of the fan, the maximum angle of the main portion of each of the tapered portions with respect to the axis is preferably 5° to 45°. Meanwhile, in order to enhance the noise reduction effect, the minimum angle of the main portion of each of the tapered portions with respect to the axis is preferably 0°. Such a range of angles is sufficiently effective in reducing noise.

The main portion of each of the tapered portions may be located between the first side section and the second side section. The remaining portion of each of the tapered portions may be located between the first side section and the third side section. The length of the remaining portion in the rotational direction may be substantially one fourth of the length of the main portion in the rotational direction or less. With this configuration, the noise reduction effect can be further enhanced.

DESCRIPTION OF THE PREFERRED EMBODIMENTS

Figure 1:
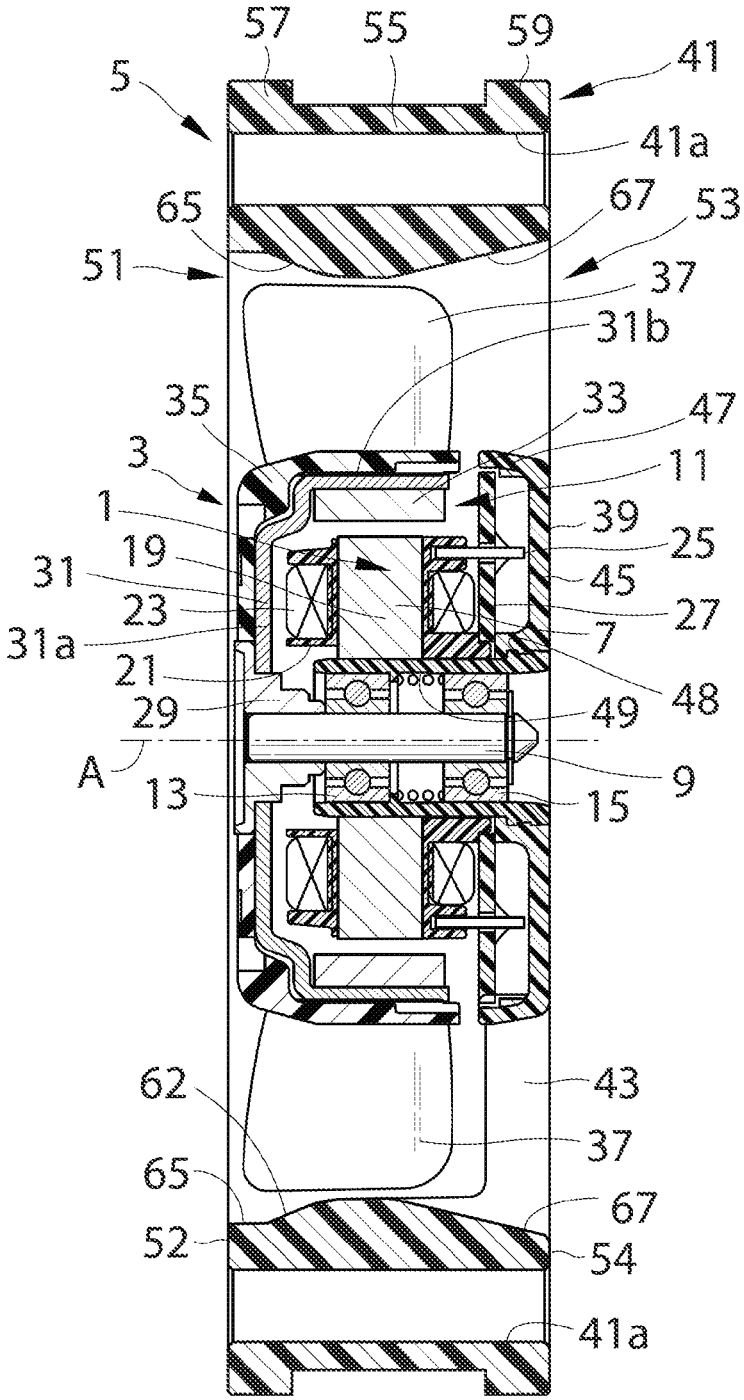
FIG. 1 is a cross-sectional view of a fan according to an embodiment of the present invention in which the present invention is applied to an axial flow fan.

An embodiment of the present invention will be described in detail below with reference to the drawings. FIG. 1 is a cross-sectional view of a fan according to the embodiment in which the present invention is applied to an axial flow fan. The fan according to the embodiment includes a motor 1, an impeller 3 rotatable by the motor 1, and a housing 5 that houses the motor 1 and the impeller 3. The housing 5 has a suction port 51 and a discharge port 53 as discussed later. The motor 1 includes a stator 7 and a rotor 11 that rotates outside of the stator 7 about a rotary shaft 9. The stator 7 includes a stator core 19 fitted outside of a bearing holder 49 that holds bearings 13 and 15 each formed by a ball bearing, an insulator 21 made of an insulating resin and fitted on the stator core 19, and a stator winding 23 wound on a plurality of salient pole portions of the stator core 19 with the insulator 21 interposed therebetween. The bearings 13 and 15 held by the bearing holder 49 rotatably support the rotary shaft 9. The stator winding 23 is electrically connected to a circuit pattern (not shown) on a circuit substrate 27 via a connection conductor 25. A drive circuit that applies an excitation current to the stator winding 23 is mounted on the circuit substrate 27.

The rotor 11 includes a cylindrical boss 29 made of an insulating material and fixed to the rotary shaft 9, a cup-shaped member 31 made of a magnetic material and attached to the rotary shaft 9 via the boss 29, and rotor-side magnetic poles 33 formed by a plurality of permanent magnets and fixed to the cup-shaped member 31. The cup-shaped member 31 has a bottom wall portion 31*a* having a through hole which is formed at the center portion and through which the boss 29 passes, and a cylindrical peripheral wall portion 31*b* extending in the axial direction of the rotary shaft 9 from the outer peripheral portion of the bottom wall portion 31*a*. The plurality of permanent magnets forming the rotor-side magnetic poles 33 are joined on the inner circumferential surface of the peripheral wall portion 31*b* of the cup-shaped member 31. The rotor-side magnetic poles 33 face the magnetic pole surfaces of the stator core 19 of the stator 7.

The impeller 3 includes an impeller main body 35 and a plurality of (in the embodiment, seven) blades 37 fixed to the impeller main body 35. The impeller 3 is integrally formed of a synthetic resin. The impeller main body 35 is fixed to the outside of the cup-shaped member 31 of the rotor 11. The plurality of blades 37 are shaped to suck an air from the suction port 51 located on one side in the axial direction of the rotary shaft 9 of the motor 1 and to discharge the air from the discharge port 53 located on the other side in the axial direction.

Figure 2:
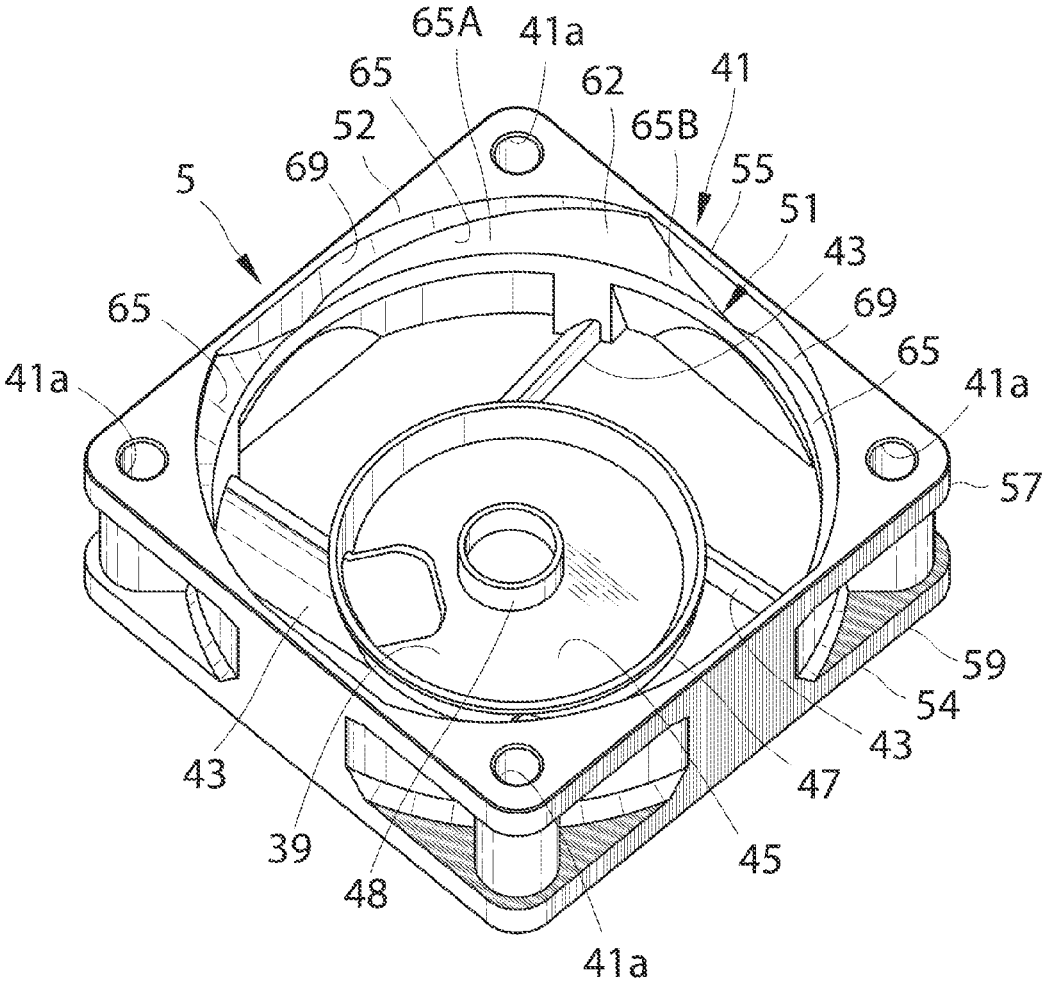
FIG. 2 is a perspective view of a housing of the fan shown in FIG. 1 as seen from the suction port side.
Figure 3:
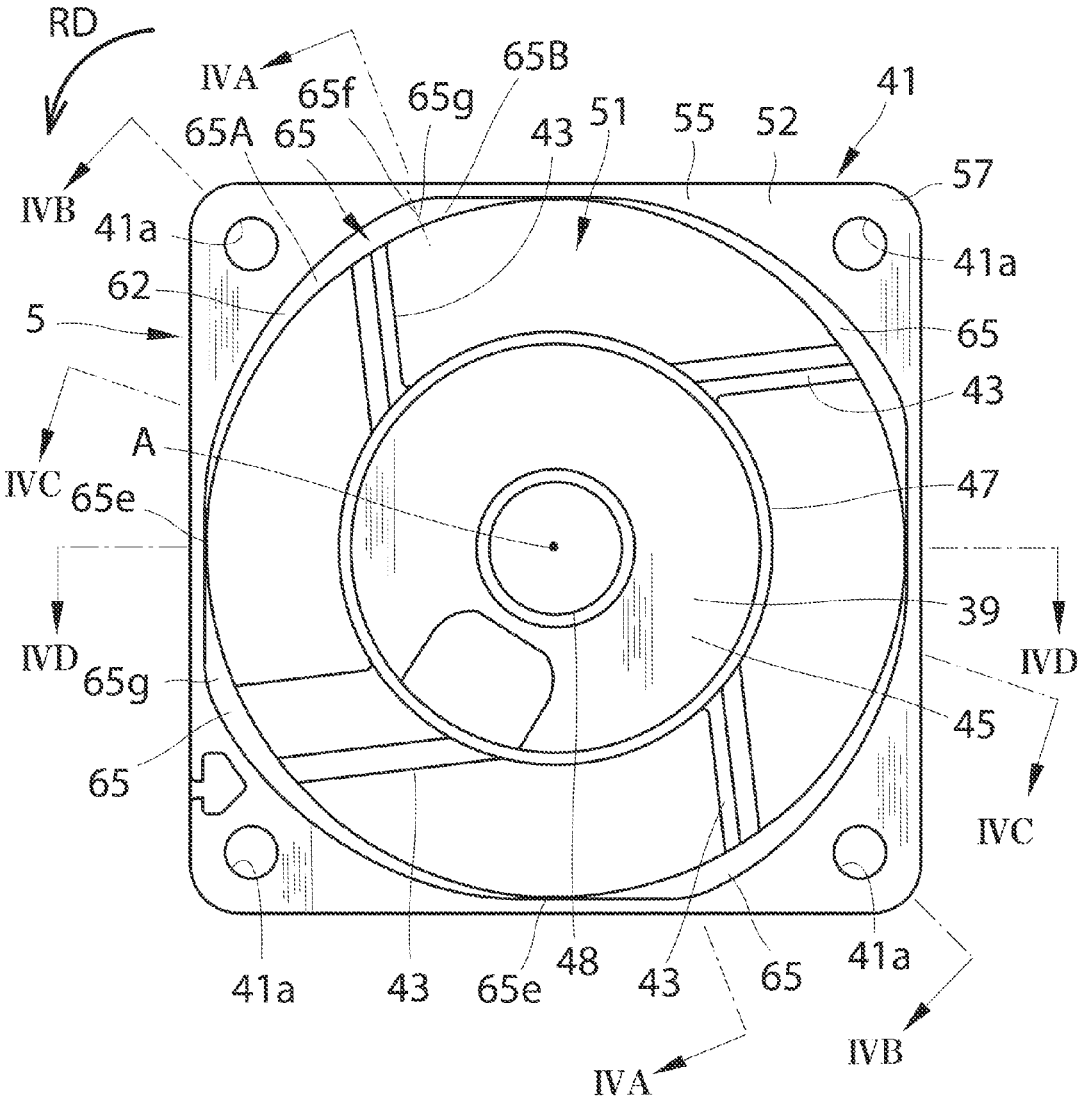
FIG. 3 is a plan view of the housing of the fan shown in FIG. 1 as seen from the suction port side.

As shown in FIGS. 2 to 4, the housing 5 includes a motor casing 39, a housing main body 41, and four webs 43 that couple the motor casing 39 and the housing main body 41 to each other. The housing 5 is integrally formed of a synthetic resin. FIGS. 2 and 3 are a perspective view and a plan view, respectively, of the housing 5 as seen from the suction port 51 side. FIGS. 4A to 4D are each a cross-sectional view taken along the line A-A, the line B-B, the line C-C, and the line D-D, respectively, of FIG. 3. As shown in FIG. 1, apart of the stator 7 and the circuit substrate 27 are housed in the motor casing 39. The motor casing 39 is disposed at the center portion of the discharge port 53, and has a bottom wall portion 45 and a peripheral wall portion 47 formed to be continuous with the bottom wall portion 45 and extending toward the suction port 51 as discussed later. A cylindrical portion 48 for attachment of the bearing holder 49 is formed at the center of the bottom wall portion 45.

The housing main body 41 includes an air channel 55 having the suction port 51 and the discharge port 53, a first flange 57 provided at an end portion on the side of the suction port 51 of the air channel 55, and a second flange 59 provided at an end portion on the side of the discharge port 53 of the air channel 55. A portion of the air channel 55 that surrounds the discharge port 53 is coupled to the peripheral wall portion 47 of the motor casing 39 by the four webs 43. Each of the first flange 57 and the second flange 59 is a substantially rectangular in profile with four rounded corners. Hence, each of two surfaces 52 and 54 of the housing main body 41 according to the embodiment, in which the suction port 51 and the discharge port 53 are respectively formed, is a substantially rectangular in profile. A through hole 41*a* through which an attachment screw passes is formed at each of the four corner portions of the first flange 57 of the housing main body 41.

Figure 4A:
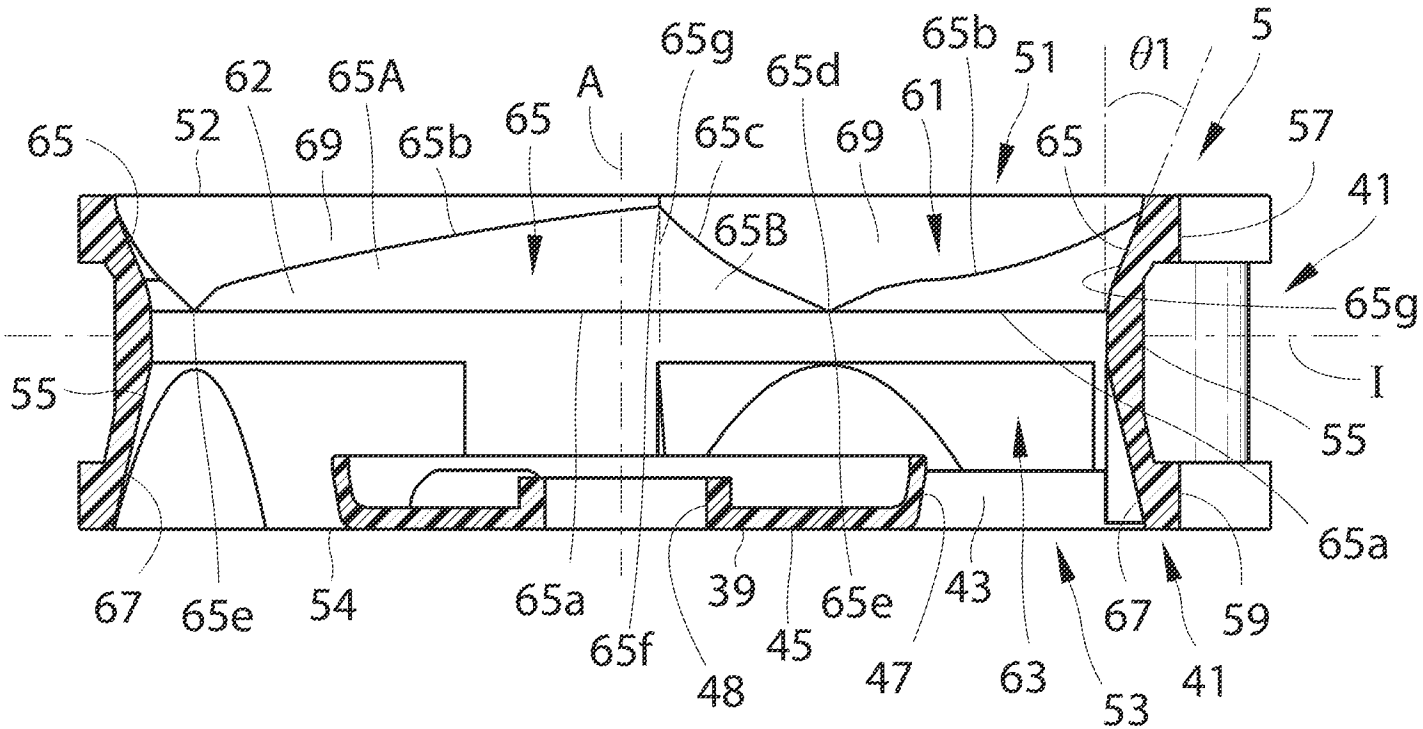
FIGS. 4A to 4D are each a cross-sectional view taken along the line A-A, the line B-B, the line C-C, and the line D-D, respectively, of FIG. 3.
Figure 4B:
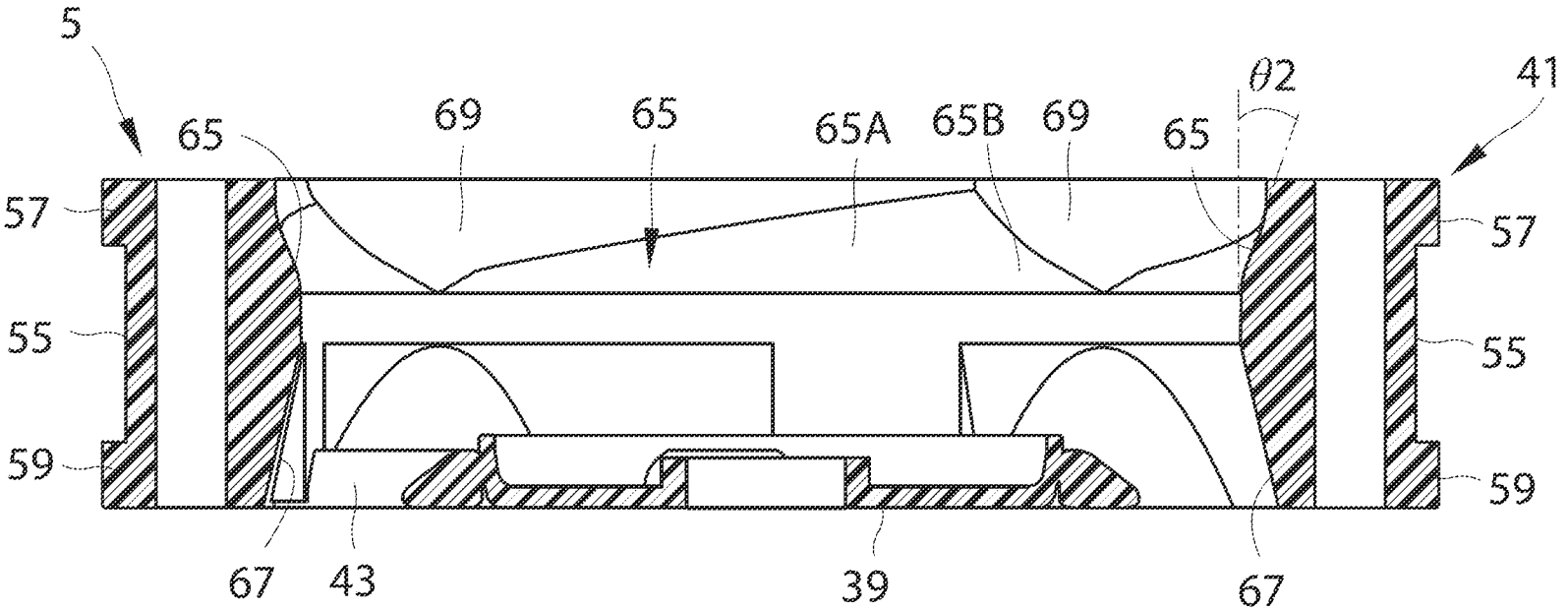
Figure 4C:
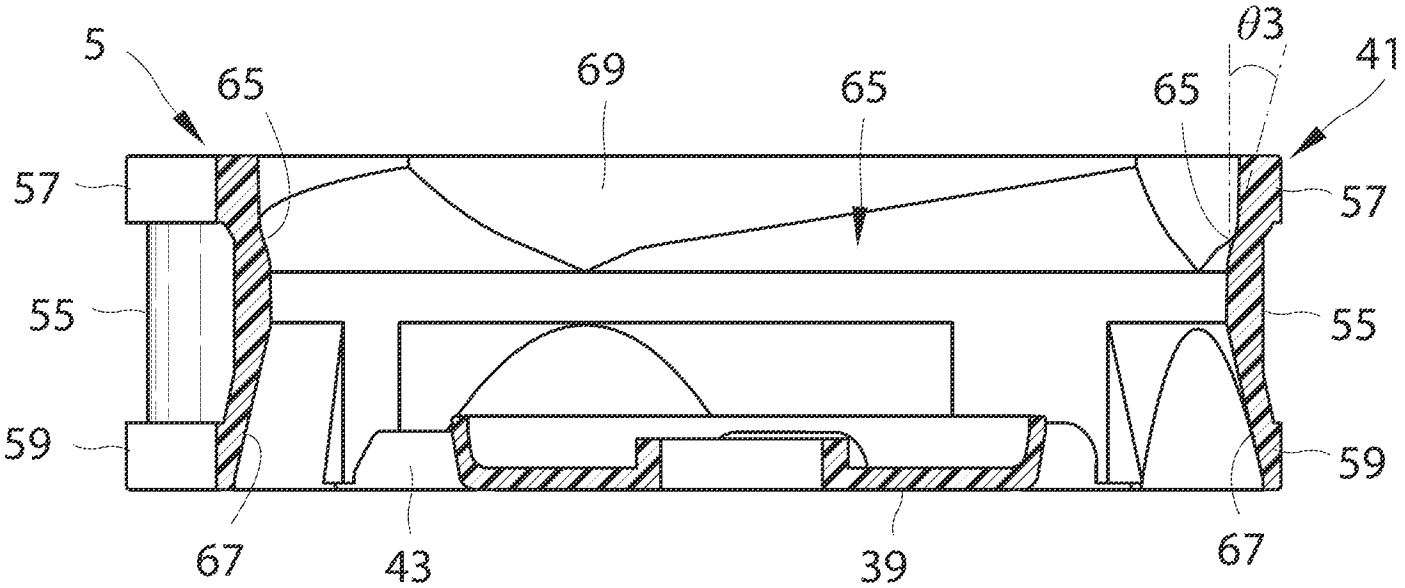
Figure 4D:
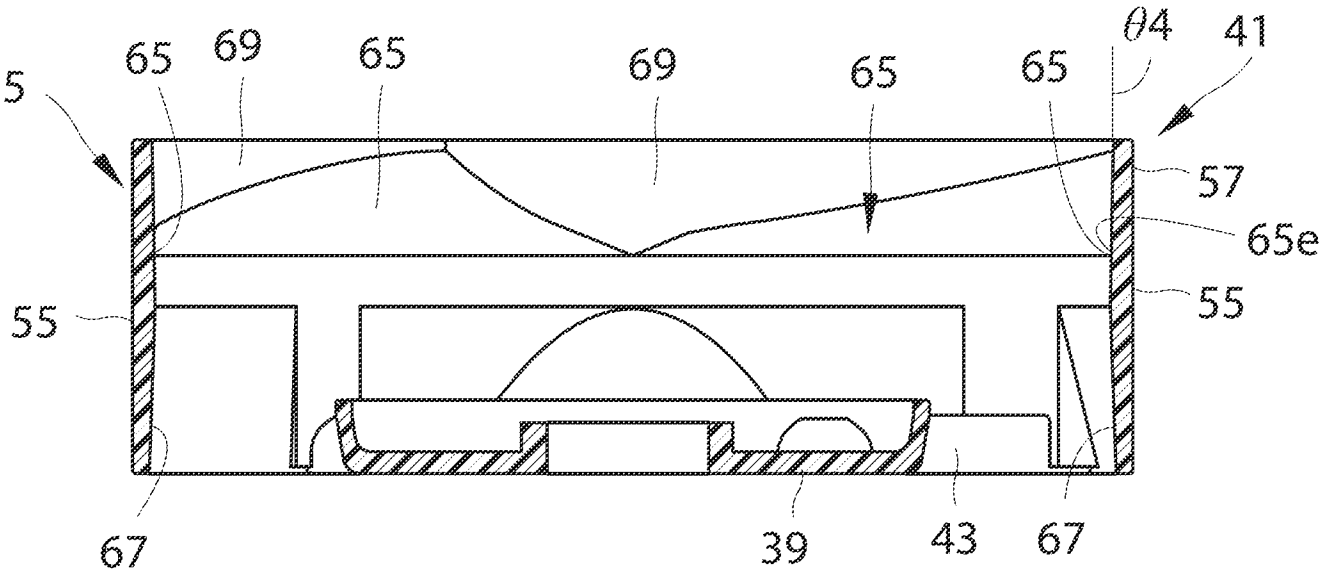

It is assumed that the air channel 55 is halved into two portions by an imaginary plane I extending orthogonally to an axis A of the rotary shaft 9 with the axis A perpendicular to the imaginary plane I as shown in FIGS. 1 and 4A. On such an assumption, the air channel 55 is halved into a first air channel portion 61 located on the suction port 51 side and a second air channel portion 63 located on the discharge port 53 side. Four tapered portions 65 are formed on an end portion of an inner wall surface of the first air channel portion 61 at four locations corresponding to the four corners of the profile of the surface 52 on the suction port 51 side (the four corner portions of the first flange 57) (FIG. 3). Also, four tapered portions 67 are formed on an end portion of an inner wall surface of the second air channel portion 63 at four locations corresponding to the four corners of the profile of the surface 54 on the discharge port 53 side (the four corner portions of the second flange 59). The four tapered portions 67 formed in the second air channel portion 63 are each inclined outwardly in the radial direction of the rotary shaft 9 from the suction port 51 side toward the discharge port 53 side, and extend in the rotational direction of the impeller 3.

Each of the four tapered portions 65 formed in the first air channel portion 61 is formed in an approximately triangular shape surrounded by first to third side sections 65*a* to 65*c*. The first side section 65*a* is located on the discharge port 53 side to extend in the rotational direction (indicated by an arrow RD in FIG. 3). The first side section 65*a* has an end portion 65*d* on a side of the one end, which is located rearward as viewed in the rotational direction RD of the impeller, and an end portion 65*e* on a side of the other end, which is located forward as viewed in the rotational direction RD of the impeller. The end portion 65*d* on the side of the one end coincides with the end portion 65*e* of an adjacent tapered portion 65 on the side of the other end. The second side section 65*b* is located on the suction port 51 side. The second side section 65*b* extends in a direction which inclines with respect to the rotational direction RD as parting from the first side section 65*a*. The second side section 65*b* approaches the first side section (65*a*) in the rotational direction RD. The second side section 65*b* has an end portion 65*f* on the side of the one end, which is located rearward as viewed in the rotational direction RD, and the end portion 65*e* on the side of the other end, at which the second side section 65*b* is coupled to the first side section 65*a*. The third side section 65*c* connects the end portion 65*d* of the first side section 65*a* on the side of the one end and the end portion 65*f* of the second side section 65*b* on the side of the one end. In other words, a main portion 65A of each of the tapered portions 65 is located between the first side section 65*a* and the second side section 65*b*, and shaped such that the second side section 65*b* approaches the first side section 65*a* in the rotational direction RD. The end portion 65*f* of the second side section 65*b* on the side of the one end is continuous with the surface 52 of the housing main body 41 on the suction port 51 side. The first side section 65*a* and the second side section 65*b* are converged on the side of the other end (the end portion 65*e* on the side of the other end). The remaining portion 65B of the tapered portion 65 is located between the third side section 65*c* and the first side section 65*a*. A parallel surface 69 extending along the second side section 65*b* and in parallel with the axis A is formed on a portion of the inner wall surface 62 of the first air channel portion 61 that is adjacent to the tapered portion 65.

As shown in FIGS. 3 and 4A to 4D, the main portion 65A of each of the tapered portions 65 is outwardly inclined in the radial direction of the rotary shaft 9 from the suction port 53 side toward the discharge port 51 side, and continuously extends in the rotational direction RD of the impeller 3. The four tapered portions 65 are equal in length in the rotational direction of the impeller 3 (FIG. 3). Further, the main portion 65A of each of the tapered portions 65 is shaped such that the angle (θ1 to θ4) between the main portion 65A and the axis A of the rotary shaft 9 (or an imaginary line extending in parallel with the axis A) becomes gradually smaller from a one end 65*g* of the main portion 65A (a position corresponding to the one end 65*f* of the second side section 65*b* and indicated by a broken line in FIGS. 3 and 4A) located rearward as viewed in the rotational direction (indicated by the arrow RD) of the impeller 3 toward the other end of the main portion 65A (the end portion 65*e* of the first side section 65*a* and the second side section 65*b* on the other end side) located forward as viewed in the rotational direction RD (in the order from FIG. 4A to FIG. 4D). In the embodiment, the maximum angle of the main portion 65A of the tapered portion 65 with respect to the axis A is 22° (θ1 in FIG. 4A). At the end portion 65*e* on the other end side, at which the angle of the tapered portion 65 with respect to the axis A is minimum, the first side section 65*a* and the second side section 65*b* are converged. Therefore, the minimum angle of the tapered portion 65 with respect to the axis A is 0° (see θ4 in FIG. 4D). According to an experiment, a maximum angle of 5° to 45° is desirable. In the embodiment, the remaining portion 65B of each of the tapered portions 65 is shaped such that the angle between the remaining portion 65B and the axis A of the rotary shaft 9 (or an imaginary line extending in parallel with the axis A) becomes gradually smaller from the one end 65*g* described above (a position corresponding to the one end 65*f* of the second side section 65*b*) and located forward as viewed in the rotational direction RD of the impeller 3 toward the one end 65*d* of the first side section 65*a* located rearward as viewed in the rotational direction RD. The length of the remaining portion 65B in the rotational direction RD is substantially one fourth of the length of the main portion 65A in the rotational direction RD or less. The variations in angle and the length of the remaining portion 65B according to the embodiment discussed above improve the noise reduction effect of the main portion 65A, rather than reducing it.

Figure 5:
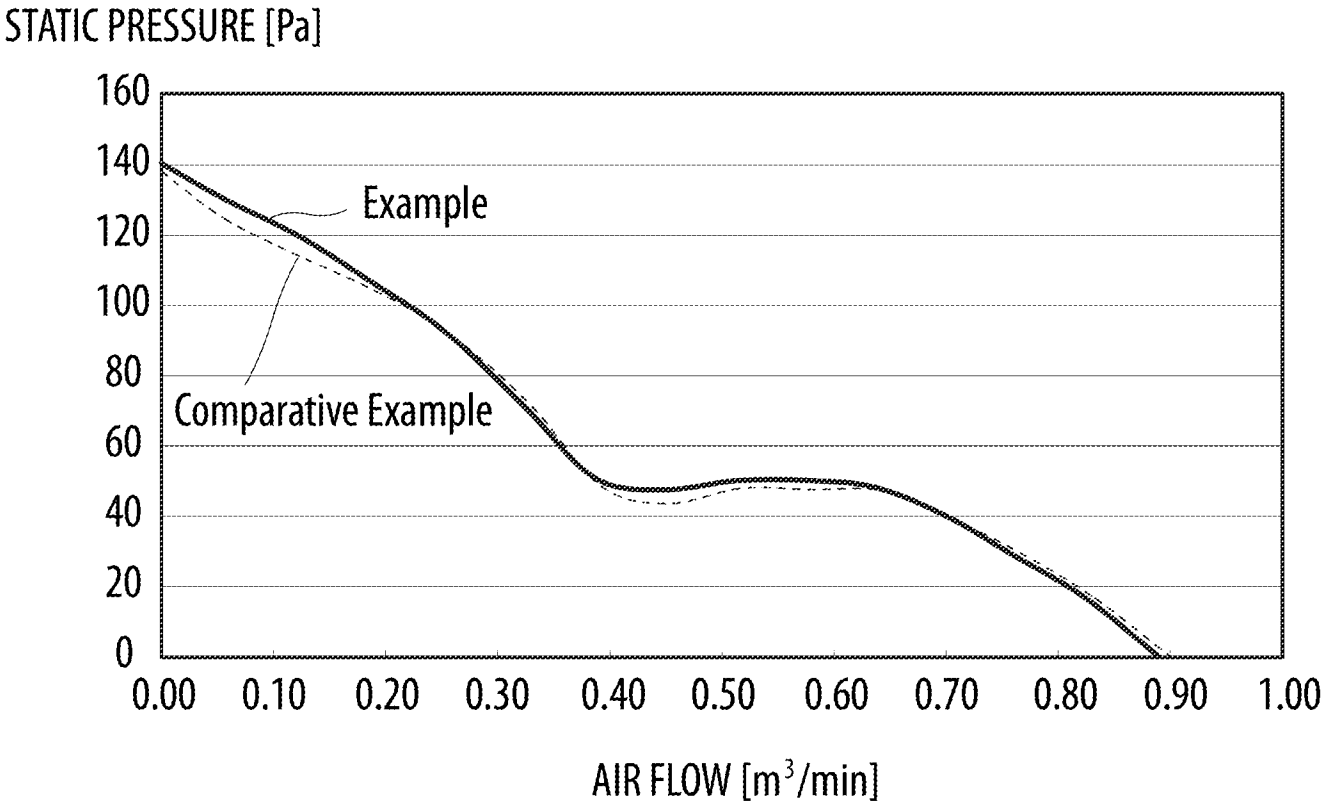
FIG. 5 shows the relationship between the static pressure and the air flow of fans tested.

Next, the static pressure and air flow characteristics were examined using the fan shown in FIGS. 1 to 4 described above (referred to as "Example") and a fan (referred to as "Comparative Example") in which the width (dimension in the axial direction) of the main portion 65A of each of the tapered portions 65 and the angle of the main portion 65A of each of the tapered portions 65 with respect to the axis are constant (with the angle being) 22°) and which is otherwise the same in structure as the fan according to Example. Specifically, the fans were rotated at 7000 rpm to measure the relationship of the static pressure with respect to the air flow. FIG. 5 shows the measurement results. It was found from FIG. 5 that the fan according to Example and the fan according to Comparative Example had substantially equal static pressure and air flow characteristics.

Figure 6:
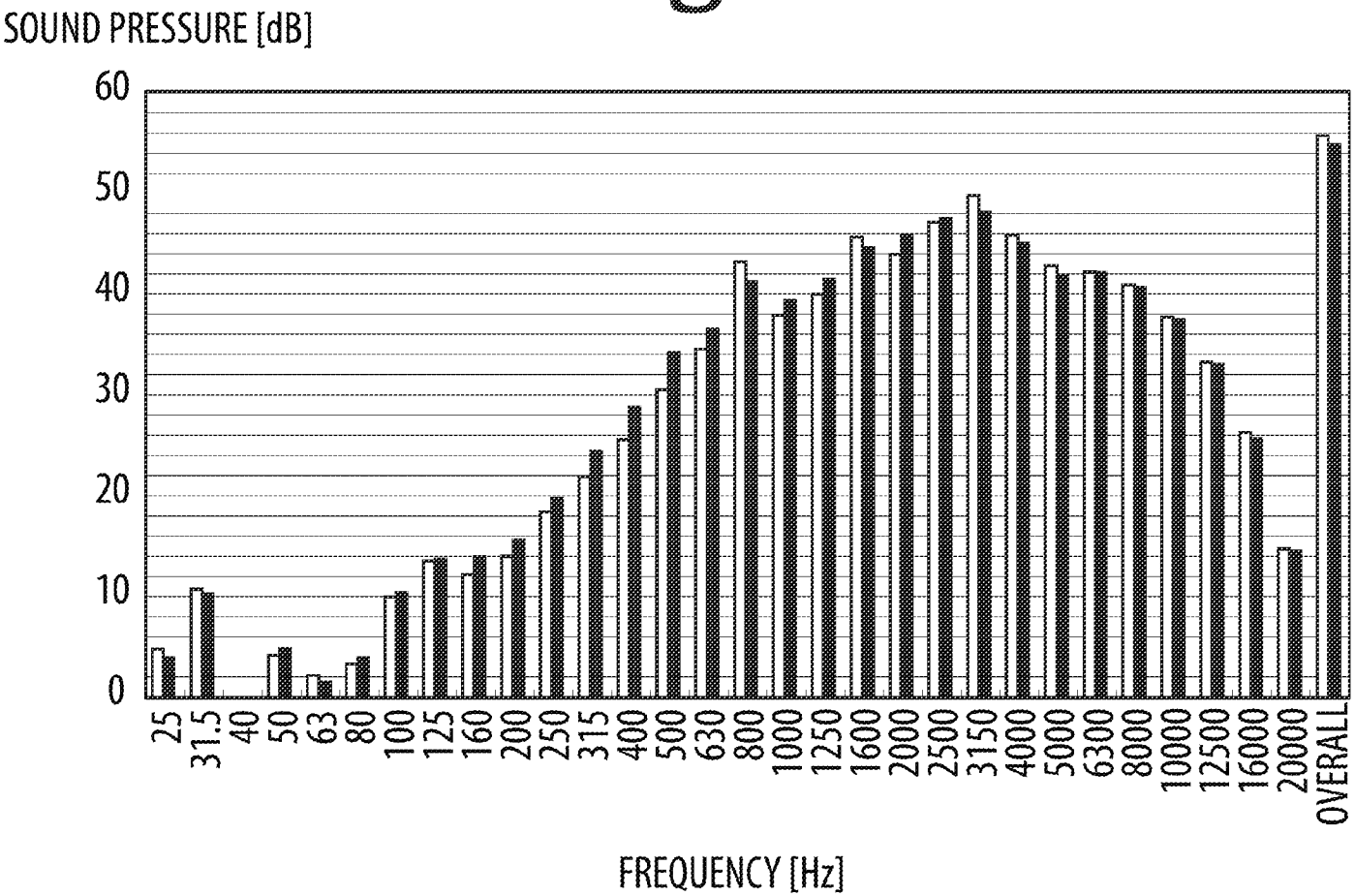
FIG. 6 shows the relationship between the frequency components and the sound pressure of noise measured at a position 30 cm away from the center of a suction port of a housing of the fans tested in the axial direction of a rotary shaft.
Figure 7:
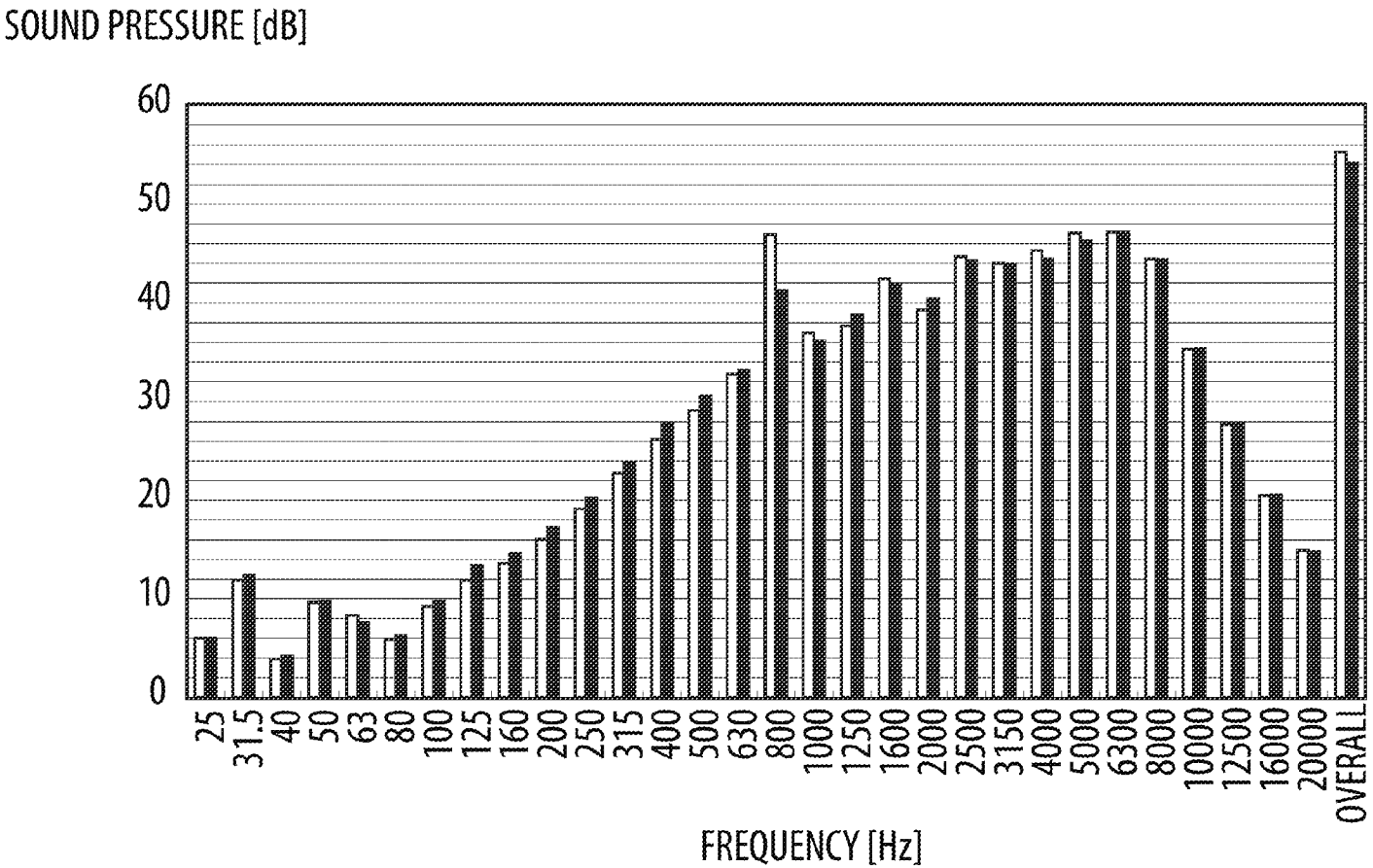
FIG. 7 shows the relationship between the frequency components and the sound pressure of noise measured at a position 30 cm away from the center of the suction port of the housing of the fans tested in a direction orthogonal to the axial direction of the rotary shaft.

Next, the fan according to Example and the fan according to Comparative Example were rotated at 7000 rpm to measure noise to analyze the relationship between the frequency components and the sound pressure of the noise. FIG. 6 shows the relationship between the frequency components and the sound pressure of noise measured at a position 30 cm away from the center of the suction port of the housing in the axial direction of the rotary shaft. FIG. 7 shows the relationship between the frequency components and the sound pressure of noise measured at a position 30 cm away from the center of the suction port in a direction orthogonal to the axial direction of the rotary shaft. In the FIGS. 6 and 7, of each pair of bars arranged side by side with each other in the horizontal direction, the left bar (in white) indicates data on the fan according to Comparative Example, and the right bar (in black) indicates data on the fan according to Example. It was found from the FIGS. 6 and 7 that the sound pressure for the fan according to Example in a relatively high frequency range (2500 to 20000 Hz) was low compared to that for the fan according to Comparative Example. It was also found that the sound pressure for the fan according to Example for frequency components (800 Hz and 1600 Hz) for which the sound pressure of the wind noise is at its peak in FIGS. 6 and 7 were each low compared to the sound pressure for the fan according to Comparative Example for frequency components (800 Hz and 1600 Hz) for which the sound pressure of the wind noise is at its peak in FIGS. 6 and 7. The sound pressure of the wind noise for the fans according to Example and Comparative Example were each at its peak for frequency components of 800 Hz and 1600 Hz due to the number (seven) of the blades of the impeller. It was found from the measurement results that the fan according to Example suppressed noise by reducing a peak of the sound pressure for frequency components in noise produced due to the number of the blades of the impeller, compared to the fan according to Comparative Example, without reducing the static pressure with respect to the air flow.

While the present invention is applied to an axial flow fan in the above embodiment, it is a matter of course that the present invention is also applicable to other fans such as a centrifugal fan and a diagonal flow fan.

Further, the present invention is not limited to the above embodiment, but various variations and modification may be made without departing from the scope of the present invention.

What is claimed is:

1. A fan comprising:

an impeller including a plurality of blades;

a motor including a rotary shaft for rotating the impeller; and a housing having a suction port, a discharge port, and an air channel that houses at least the impeller and allows an air to be sucked from the suction port and discharged from the discharge port when the impeller rotates, wherein:

a surface of the housing, in which the suction port is formed, is substantially rectangular in profile;

four tapered portions are formed on an end portion of an inner wall surface of the air channel at four locations corresponding to four corners of the profile of the surface of the housing where the suction port is formed, the four tapered portions are each inclined outwardly in a radial direction of the rotary shaft from the discharge port side toward the suction port side and extending in a rotational direction of the impeller; and the tapered portions each include a main portion which is shaped such that an angle formed between the main portion and an axis of the rotary shaft gradually becomes smaller from one end of the main portion located rearward as viewed in the rotational direction of the impeller toward the other end of the main portion located forward as viewed in the rotational direction of the impeller.

2. The fan according to claim 1, wherein assuming that the air channel is halved by an imaginary plane that is perpendicular to the axis into a first air channel portion located on the suction port side and a second air channel portion located on the discharge port side, the tapered portions are formed on an inner wall surface of the first air channel portion.

3. The fan according to claim 2, wherein the main portion of each of the tapered portions has a first side section located on the discharge port side and extending in the rotational direction, a second side section located on the suction port side, and a third side section connecting the first side and the second side sections, and the main portion of each of the tapered portions is shaped such that the second side section approaches the first side section in the rotational direction.

4. The fan according to claim 3, wherein:

an end portion of the second side section of each of the tapered portions that is on a side of the one end side is continuous with the surface of the housing in which the suction port is formed; and the first side section and the second side section are converged on the side of the other end.

5. The fan according to claim 4, wherein a parallel surface extending along the second side section and in parallel with the axis is formed on the inner wall surface of the first air channel portion.

6. The fan according to claim 1, wherein the four tapered portions are equal in length in the rotational direction.

7. The fan according to claim 2, wherein the maximum angle of the main portion of each of the tapered portions with respect to the axis is 5 to 45°, and the minimum angle of the main portion of each of the tapered portions with respect to the axis is 0°.

8. The fan according to claim 1, wherein:

the main portion of each of the tapered portions is located between the first side section and the second side section;

a remaining portion of each of the tapered portions is located between the first side section and the third side section; and the length of the remaining portion in the rotational direction is substantially one fourth of the length of the main portion in the rotational direction or less.

9. The fan according to claim 2, wherein:

a surface of the housing in which the discharge port is formed, is a substantially rectangular in profile; and four tapered portions are formed on an end portion of an inner wall surface of the second air channel portion at four locations corresponding to four corners of the profile of the surface of the housing where the discharge port is formed, and the tapered portions are each inclined outwardly in the radial direction of the rotary shaft from the suction port side toward the discharge port side and extending in the rotational direction of the impeller.

10. The fan according to claim 3, wherein:

a surface of the housing in which the discharge port is formed, is a substantially rectangular in profile; and four tapered portions are formed on an end portion of an inner wall surface of the second air channel portion at four locations corresponding to four corners of the profile of the surface of the housing where the discharge port is formed, and the tapered portions are each inclined outwardly in the radial direction of the rotary shaft from the suction port side toward the discharge port side and extending in the rotational direction of the impeller.

11. The fan according to claim 4, wherein:

a surface of the housing in which the discharge port is formed, is a substantially rectangular in profile; and four tapered portions are formed on an end portion of an inner wall surface of the second air channel portion at four locations corresponding to four corners of the profile of the surface of the housing where the discharge port is formed, and the tapered portions are each inclined outwardly in the radial direction of the rotary shaft from the suction port side toward the discharge port side and extending in the rotational direction of the impeller.

12. The fan according to claim 5, wherein:

a surface of the housing in which the discharge port is formed, is a substantially rectangular in profile; and four tapered portions are formed on an end portion of an inner wall surface of the second air channel portion at four locations corresponding to four corners of the profile of the surface of the housing where the discharge port is formed, and the tapered portions are each inclined outwardly in the radial direction of the rotary shaft from the suction port side toward the discharge port side and extending in the rotational direction of the impeller.

13. The fan according to claim 6, wherein:

a surface of the housing in which the discharge port is formed, is a substantially rectangular in profile; and four tapered portions are formed on an end portion of an inner wall surface of the second air channel portion at four locations corresponding to four corners of the profile of the surface of the housing where the discharge port is formed, and the tapered portions are each inclined outwardly in the radial direction of the rotary shaft from the suction port side toward the discharge port side and extending in the rotational direction of the impeller.

14. The fan according to claim 7, wherein:

a surface of the housing in which the discharge port is formed, is a substantially rectangular in profile; and four tapered portions are formed on an end portion of an inner wall surface of the second air channel portion at four locations corresponding to four corners of the profile of the surface of the housing where the discharge port is formed, and the tapered portions are each inclined outwardly in the radial direction of the rotary shaft from the suction port side toward the discharge port side and extending in the rotational direction of the impeller.

15. The fan according to claim 8, wherein:

a surface of the housing in which the discharge port is formed, is a substantially rectangular in profile; and four tapered portions are formed on an end portion of an inner wall surface of the second air channel portion at four locations corresponding to four corners of the profile of the surface of the housing where the discharge port is formed, and the tapered portions are each inclined outwardly in the radial direction of the rotary shaft from the suction port side toward the discharge port side and extending in the rotational direction of the impeller.

* * * * *